US007506526B2

(12) United States Patent
Yamakawa et al.

(10) Patent No.: US 7,506,526 B2
(45) Date of Patent: Mar. 24, 2009

(54) SEAMLESS TUBE PIERCING/ROLLING PLUG, AND SEAMLESS TUBE PRODUCING METHOD USING SAME

(75) Inventors: Tomio Yamakawa, Amagasaki (JP); Kazuhiro Shimoda, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/010,303

(22) Filed: Jan. 23, 2008

(65) Prior Publication Data

US 2008/0134742 A1 Jun. 12, 2008

Related U.S. Application Data

(63) Continuation of application No. 11/517,436, filed on Sep. 8, 2006, now Pat. No. 7,383,710, which is a continuation of application No. PCT/JP2005/004309, filed on Mar. 11, 2005.

(30) Foreign Application Priority Data

Mar. 11, 2004 (JP) ..... 2004-068744
Mar. 11, 2004 (JP) ..... 2004-069005

(51) Int. Cl.
*B21B 19/04* (2006.01)

(52) U.S. Cl. ..... 72/97; 72/209; 72/478

(58) Field of Classification Search ..... 72/97, 72/209, 462, 478, 481.1
See application file for complete search history.

(56) References Cited

U.S. PATENT DOCUMENTS 792,231 A 6/1905 Nicholson
1,951,087 A 3/1934 Dunn
2,176,155 A 10/1939 Stiefel
4,022,043 A 5/1977 Chevet
4,149,396 A 4/1979 Meurer et al.

(Continued)

FOREIGN PATENT DOCUMENTS

JP 58-167004 10/1983

(Continued)

*Primary Examiner*—Edward Tolan
(74) *Attorney, Agent, or Firm*—Clark & Brody

(57) ABSTRACT

The present invention provides a seamless tube piercing/rolling plug and a seamless tube producing method in which piercing/rolling is performed with an inclined rotary piercing mill while the seamless tube piercing/rolling plug is used as a piercing tool. The seamless tube piercing/rolling plug is used while a front part and a rear part of the split plug are held as an integral plug, at least the front part is made of low alloy steel, and oxide films are formed on surfaces of the front part and rear part. The present invention also provides a seamless tube piercing/rolling apparatus and a seamless tube producing method in which the front part and/or rear part is replaceable in a tube making process line using the seamless tube piercing/rolling apparatus. In the seamless tube piercing/rolling apparatus, the front part and rear part are held as the integral plug, the front part and/or rear part is removably mounted, a mandrel bar holding the plug goes through the rear part, and the mandrel bar is coupled with the front part. It is preferable that a thickness of the oxide film formed in the front part be set to 200 μm or more while the oxide film formed in the front part is thicker than the oxide film formed in the rear part. Even if a hard working material is pierced/rolled, a seam defect and inside surface defects are eliminated, and excellent life-time of plug and excellent plug cost per production quantity can be achieved.

10 Claims, 6 Drawing Sheets

U.S. PATENT DOCUMENTS

| | | | | |
|---|---|---|---|---|
| 4,393,677 | A | 7/1983 | Tamura et al. | |
| 4,466,265 | A | 8/1984 | Wessel | |
| 5,031,434 | A | 7/1991 | Takase et al. | |
| 5,778,714 | A * | 7/1998 | Katsumura et al. | 72/97 |
| 6,073,331 | A * | 6/2000 | Katsumura et al. | 29/423 |
| 6,202,463 | B1 | 3/2001 | Yorifuji et al. | |
| 6,988,387 | B2 | 1/2006 | Nakaike et al. | |
| 7,383,710 | B2 * | 6/2008 | Yamakawa et al. | 72/97 |

FOREIGN PATENT DOCUMENTS

| | | |
|---|---|---|
| JP | 59-225805 | 12/1984 |
| JP | 60-137511 | 7/1985 |
| JP | 62-207503 | 9/1987 |
| JP | 63-095604 | 5/1988 |
| JP | 63-203205 | 8/1988 |
| JP | 01-289504 | 11/1989 |
| JP | 02-063604 | 3/1990 |
| JP | 02-142604 | 5/1990 |
| JP | 02-251304 | 10/1990 |
| JP | 06-328105 | 11/1994 |
| JP | 07-060314 | 3/1995 |
| JP | 2581154 | 11/1996 |
| JP | 09-276910 | 10/1997 |
| JP | 10-156410 | 6/1998 |
| JP | 10-180315 | 7/1998 |
| JP | 10-249412 | 9/1998 |
| JP | 10-277610 | 10/1998 |
| JP | 2000-167606 | 6/2000 |
| JP | 2002-113507 | 4/2002 |

* cited by examiner

SEAMLESS TUBE PIERCING/ROLLING PLUG, AND SEAMLESS TUBE PRODUCING METHOD USING SAME

This application is a continuation of U.S. application Ser. No. 11/517,436 filed Sep. 8, 2006 now U.S. Pat. No. 7,383,710, which is a continuation of International Patent Application No. PCT/JP2005/004309 filed Mar. 11, 2005. The PCT application was not in English as published under PCT Article 21(2).

TECHNICAL FIELD

The present invention relates to a piercing/rolling plug suitable for an inclined rotary piercing method which is of a typical seamless tube producing method, and apparatus and method for producing the seamless tube therewith, more particularly to the piercing/rolling plug which has excellent durability and prevent generation of inside surface defects of the seamless tube in the piercing, a split plug whose front part and/or rear part can be replaced, and the apparatus and method for producing the seamless tube therewith.

BACKGROUND ART

In the so-called Mannesmann tube making process used as the typical method of producing the seamless tube, a billet heated to a predetermined temperature is fed to a piercer, and a hollow shell is produced by piercing an axial center portion of the solid billet. Then, the pierced hollow shell is passed through an elongating mill (mandrel mill) composed of five to eight stands to undergo a process of reducing the wall thickness of the hollow shell. After or without re-heating the hollow shell, correcting in the form and sizing are performed by a stretch reducing mill or a sizing mill. Then, a finishing process is performed to the hollow shell to obtain the seamless tube which is of a product.

In the rolling with the piercer, inclined rolls oppose to each other with respect to a pass line such that the billet which is of a material to be rolled is moved in a rolling direction along the pass line. A plug is also positioned between the inclined rolls, and the plug is held by a mandrel bar arranged on the pass line.

FIG. 1 is a view schematically explaining an arrangement of the inclined rolls used in piercing. FIG. 2 is a view explaining the arrangement of the inclined roll, seen from the direction of an arrow A-A shown in FIG. 1.

As shown in FIG. 1, inclined rolls 1 are arranged in an axisymmetrical manner such that roll axis lines respectively form cross angles $\gamma$ with respect to a pass line X-X. As shown in FIG. 2, the inclined roll 1 is arranged so as to form a feed angle $\beta$ with respect to the pass line X-X. On the other hand, the other inclined roll 1 (not shown in FIG. 2) is also arranged so as to be reversely inclined with the feed angle $\beta$ across the pass line X-X.

The inclined rolls 1 applying screwing movement to a billet 3 are directly coupled with drive devices 4 respectively, and thereby the inclined roll 1 can be rotated about the roll axis line while the cross angle $\gamma$ and the feed angle $\beta$ are separately maintained. Disk rolls 5 serving for a tube material guide are also arranged between the inclined rolls 1 and 1 as opposed to each other, wherein the disk rolls 5 oppose to each other with respect to the pass line X-X while a phase of the disk rolls 5 differs from that of the inclined rolls by 90°. In FIG. 2, the disk rolls 5 are shown by an alternate long and short dash line as an imaginary line. An end portion of a plug 2 is supported by a front end of a mandrel bar M, and the plug 2 is arranged on the pass line X-X as a tool for piercing/rolling. In the piercer having the above configuration, during the period when the billet 3 fed in the direction of an outline arrow sign on the pass line X-X is passed through a gap between the inclined rolls, the part of the billet 3 at the instant passing stage is pierced into a hollow part while the process of reducing the wall thickness thereof is also performed by the inclined rolls 1 and the plug 2, whereby the billet 3 is moved forward along the pass line X-X while revolving, and eventually the plug 2 makes an entire hole in the axial center portion of the billet 3 to yield the hollow shell.

FIG. 3 is a view showing an outer contour profile in a longitudinal direction of the plug adopted as the tool for piercing/rolling. Usually, the plug 2 includes a rolling section, a reeling section, and a relief section, and the plug 2 is formed in a cannon ball shape in which the rolling section has a sharp-nosed leading edge portion.

A Cr—Ni low alloy steel is usually used as a plug material of the tool for piercing/rolling. In order to obtain heat insulating effects and lubricating effects in the piercing, before using the plug 2, heat treatment is performed to the plug in an oxidizing atmosphere to form an oxide film on a surface of the plug 2. A thickness of the oxide film ranges from 100 to 1000 μm, and the oxide film is mainly composed of iron oxide.

However, as shown in FIG. 3, in the sharp-nosed front end portion of the rolling section of the plug 2 used as the tool for piercing/rolling, a volume is small, and a temperature rapidly rises by heat generation of the material to be rolled in association with the piercing. In the case where base material strength of the plug cannot withstand a load of heat, dissolution wastage is generated in the front end portion of the plug.

When the piercing is performed with the plug in which the dissolution-induced metal loss is generated in the front end portion, the inside surface defects are generated in the hollow shell, which results in a large problem in quality. When a degree of the generated dissolution wastage is increased, it is necessary to interrupt the rolling in the way through the piercing process, which results in a significant decrease in productivity.

The following is the durability of the plug. When the material to be rolled is made of carbon steel, the plug can withstand the piercing runs for more than 100 passes. However, when the material to be rolled is made of stainless steel or high alloy steel, it is necessary to scrap the plug after several passes. Usually the damage which is judged as the end of a life-time of the plug is concentrated on the plug front part. The plug whose life-time is ended is recycled by remachining the plug to an extent in which a trouble is not generated in the mandrel bar holding the plug. When the plug exceeds the remachining range, the plug is scrapped.

Therefore, the life-time of plug has a large influence on production cost of the seamless tube. Particularly, with deep drilling of an oil well or development of oil well in the sea bottom in recent years, an expense ratio of the plug tool cost rises more and more in the production cost of the seamless tube by increasing needs for stainless steel or high alloy steel in which the impact on the plug is increased in the piercing.

In order to achieve the extension of the life-time of plug, there are various proposals. For example, Japanese Patent Application Publication No. 7-60314 proposes a plug which is made of Cr—Ni low alloy steel to form the thick oxide film on the plug surface. Elements such as W, Mo, Nb, Ti, and Nb are added to the Cr—Ni low alloy steel in order to form the oxide film which has excellent adhesion to the base metal.

However, when the piercing is performed with the plug proposed in Japanese Patent Application Publication No. 7-60314, the oxide film on the plug partially comes off to degrade surface quality of the plug. When the piercing is performed with the plug whose surface quality becomes degraded, the surface quality of the plug is printed to an inner surface of the material to be rolled, and the surface quality is degraded in the inner surface of the hollow shell after the rolling. When finish rolling is further performed to the hollow shell with a mill, many minute seam defects in a rice grain form are generated in the inner surface of the mother pipe after the final finishing rolling.

Japanese Patent Application Publication No. 10-249412 proposes a piercing/rolling plug in which the plug reeling section is smaller than the rolling section in the thickness of oxide film. In the production of the plug proposed in Japanese Patent Application Publication No. 10-249412, the thick film is evenly formed on the plug surface, and the film of the reeling section is mechanically ground to decrease the film thickness. In grinding the film of the reeling section, it is necessary to strictly manage a grinding amount.

However, before forming the film, frequently the plug shape is not formed in a perfect circle. Therefore, it is difficult that the film thickness is strictly adjusted in a circumferential direction of the plug, and the damage is generated in a plug region where the film thickness is not more than a necessary thickness.

Japanese Patent Application Publication No. 2002-113507 proposes a rolling plug which includes a coated layer on an outer surface, wherein the coated layer is made of a niobium-base alloy having predetermined resistance to compressive deformation, and the niobium-base alloy contains Ti in the range of 7 to 45 mass %. Japanese Patent Application Publication No. 6-328105 proposes a tool for rolling/piercing in which the coated layer containing Mo, Ni, and Cr is formed by overlay welding. Japanese Patent Application Publication No. 2-63604 proposes a plug in which a portion coming into contact with the material to be rolled is formed by a porous dispersed layer and a continuum phase having a melting point lower than that of the porous dispersed layer. The porous dispersed layer is formed by Mo-base alloy powders.

However, when the plugs proposed in Japanese Patent Application Publication Nos. 2002-113507, 6-328105, and 2-63604 are adopted, unit cost of the plug becomes expensive compared with the Cr—Ni low alloy steel as describe later, and the expense ratio of the plug tool cost is further increased in the production cost of the seamless tube.

DISCLOSURE OF THE INVENTION

As can be seen from the above description of the background art, the new improvement is required because the sufficient effect cannot be exerted only by the method of forming the oxide film on the one-piece type plug surface. On the other hand, recently many proposals concerning the split plug in which the plug is divided into a front part and a rear part are made instead of the conventional one-piece type plug.

For example, Japanese Patent Application Publication No. 10-180315 proposes a split plug in which the front part thereof is made of ceramic. However, although ceramic has large compressive strength and a high wear-resistant property at high temperatures, ceramic is inferior in resistance to impact. Therefore, there is a fear that the plug is broken from the front end in the piercing/rolling which is done in a harsh condition.

Japanese Patent Application Publication No. 63-203205 proposes a plug in which the Mo alloy having high high-temperature strength is bonded to the plug front part. Japanese Patent Application Publication No. 10-156410 proposes a plug in which the front part is made of the Nb alloy and the surface of the front part has silicide. However, according to the study of the present inventors, when high alloy steel such as the Mo alloy and the Nb alloy is used for the front part of the split plug, the piercing efficiency is largely decreased because of a large coefficient of friction. Therefore, the number of rotary forging is increased until the material to be rolled reaches the front end of the plug from onset engagement with inclined rolls, and the inside surface defects are easily generated by the Mannesmann fracture effect.

The cost of ceramic, Mo alloy, or Nb alloy is ten times or more compared with that of the Cr—Ni low alloy steel. Even if any one of the plugs proposed in Japanese Patent Application Publication Nos. 2002-113507, 6-328105, and 2-63604 and the split plugs proposed in Japanese Patent Application Publication Nos. 10-180315 and 63-203205 is adopted, an enormous cost is required in view of the preparation of the plugs having sizes and types according to a tube making schedule.

Then, the study will be made from the standpoint of mechanism of "split plug." Conventionally, there is proposed the plug (hereinafter referred to as "conventional split plug") in which the plug front part and the plug rear part are separately produced and then the plug front part and the plug rear part are integrally assembled. The conventional split plug is based on an idea that the life-time of plug can be lengthened when only the plug front part is made of the high strength material, because the dissolution wastage generated in the plug front part becomes a factor which determines the life-time of plug.

However, according to the study of the present inventors, in any conventional split plug, there is a problem in a method of attaching the front part, and practical use is hardly realized in some conventional split plugs. The problem will be described below.

Japanese Patent No. 2581154 (Japanese Patent Application Publication No. 1-289504) proposes a plug in which the front part is made of the Nb alloy. In Japanese Patent No. 2581154, the methods, such as shrink fitting, press insert, and pressure welding, are cited as an example of means for bonding the front part and the rear part.

Japanese Patent Application Publication No. 62-207503 discloses a plug in which the Mo alloy is mounted to the front part, and a shrink fitting method and an adhesive bonding method can be adopted in addition to the screw method in bonding the Mo alloy and the front part. In Japanese Patent Application Publication No. 60-137511, it is described that the jointed portion is formed by the shrink fitting or the adhesive glue.

On the other hand, Japanese Patent Application Publication No. 58-167004 proposes a plug in which the front part is divided into plural segments aligned in series along the axial line and each divided segment is held by a bearing rotatable about the axial line. In the plug proposed in Japanese Patent Application Publication No. 58-167004, although the front part can be rotated owing to the bearing, it is difficult to readily attach/detach the front part due to the very rotatable construction of the front part.

Japanese Utility Model Publication No. 63-95604 discloses a plug in which the front part is made of a heat-resistant alloy having both the high melting point and the high high-temperature strength and the rear part is made of alloy steel in which a scale is easily generated. Japanese Utility Model Publication No. 63-95604 shows that the front part and the rear part are jointed by the screw method.

Japanese Patent Application Publication No. 2000-167606 proposes a plug in which the front part and the rear part are connected with a holding member having a different-diameter part which has a function of preventing the drop-out.

However, as with the plug disclosed in Japanese Patent Application Publication No. 58-167004, although the front part can be rotated, it is difficult to attach/detach the front part.

As described above, the conventional split plug can roughly be classified into two types, i.e., one in which the plug front part and the plug rear part are fixed to each other and the other in which the plug front part and the plug rear part are rotatable. In the former type in which the plug front part is fixed, the jointed part is likely to be broken by torsion applied during the piercing. On the other hand, in the latter type in which the plug front part is rotatable, the joint construction becomes complicated, and the failure is likely generated during the piercing.

In view of the problems of the conventional one-piece type plug and split plug, the present invention has the following two objects. It is a first object of the present invention to provide a seamless tube piercing/rolling plug and a seamless tube producing method therewith. In the seamless tube piercing/rolling plug, even if the stainless steel or high alloy steel is pierced/rolled, the minute seam defects in a rice grain form caused by the oxide film on the plug surface is eliminated while the generation of the inside surface defects caused by the rotary forging effect (Mannesmann fracture effect) during engaging the material to be rolled in the inclined rolls is simultaneously prevented, and the extension of the life-time of plug and the excellent plug cost per production quantity can be achieved.

It is a second object of the present invention to provide a seamless tube piercing/rolling apparatus and a producing method therewith. In the seamless tube piercing/rolling apparatus, even in the plug divided into the front part and the rear part, the plug front part and/or the plug rear part can be replaced without generating the trouble in jointing the split plugs during seamless tube making process in on-line operation, and thereby the extension of the life-time of plug and the excellent plug cost per production quantity can be achieved.

Therefore, the study is made from the viewpoint of (A) appropriate thickness of the oxide film in the split plug in order to achieve the first object, and the study is made from the viewpoint of (B) appropriate structure of the split plug in order to achieve the second object.

(A) Appropriate Thickness of Oxide Film in Split Plug

The conventional split plug is only based on the idea that the life-time of plug can be lengthened when only the front part is made of the high strength material, because the dissolution wastage generated in the plug front part becomes the factor which determines the life-time of plug. Therefore, the present inventors focused on a front part function, a rear part function, and action of the oxide film, which had not been studied in the split plug, and the present inventors studied the life-time of plug and the generation of the inside surface defects by changing the material in each region of the plug or the thickness of the oxide film.

As a result, it is found that the functions of front part and rear part of the split plug can effectively be staged by forming the oxide film having the appropriate thickness on the plug surface. As used herein, desirably "plug front part" shall mean a part assigned from a plug front end to a reeling start point, although "plug front part" does not restrict a range in a longitudinal direction.

The above study was performed by experiments in which a model piercer having the same structure as the inclined piercer shown in FIG. 1. FIG. 4 is a front sectional view showing a configuration in a lengthwise direction of the split plug used in the above study. A split plug 2 used is formed by jointing a front part 21 and a rear part 22, and the split plug 2 exhibits a cannon ball type as a whole.

In the experiments, (1) SiC ceramic and SiN ceramic, (2) Mo alloy (Mo-0.5% Ti-0.08% Zr), (3) Nb alloy (Nb-10% W-2.5% Zr), and (4) Cr—Ni low alloy steel were used as the material of the front part 21. Two grades of Cr—Ni low alloy steel: a steel type A and a steel type B were prepared, and Table 1 shows chemical compositions of the two grades of Cr—Ni low alloy steel. The two grades of Cr—Ni low alloy steel: the steel type A and steel type B were also used as the material of the rear part 22 used in the experiments.

TABLE 1

| | Chemical compositions (mass %, the remainder includes Fe and unavoidable impurities) | | | | |
|---|---|---|---|---|---|
| Steel type | C | Cr | Ni | W | Mo |
| A | 0.15 | 0.52 | 1.03 | 3.05 | 1.50 |
| B | 0.25 | 3.01 | 1.02 | — | — |

The heat treatment was performed to the plug 2 made of Cr—Ni low alloy steel by placing the plug 2 in a heating furnace with an oxidizing atmosphere, and the oxide films whose thicknesses were 150 μm, 350 μm, 400 μm, and 500 μm were formed on the surfaces of the front parts while the oxide film whose thickness was 200 μm was formed on the surface of the rear part. A screw thread type was used to couple the front part 21 with the rear part 22 in all the split plugs 2, and the split plug 2 was made such that a maximum diameter Pd of the rear part 22 was adjusted to be 54 mm. SUS316 material grade was used as a sample material, and the billet having outer diameter of 70 mm×length of 500 mm was prepared. The billet was heated at a heating temperature of 1260° C., and the billet was pierced/rolled using the prepared split plug to obtain the hollow shell having the outer diameter of 74 mm.

For the piercing/rolling conditions, the inclined roll diameter D was set to 400 mm, the cross angle γ was set to 15°, and the feed angle β was set to 10°. After the piercing/rolling, the life-time of plug, the piercing efficiency (slip ratio), and the inside surface defects were investigated. Table 2 shows the plug conditions used in the piercing/rolling experiments and the investigation results after the piercing/rolling.

TABLE 2

| | Plug front part | | Plug rear part | | Investigation result after piercing | | |
|---|---|---|---|---|---|---|---|
| Test No. | Material | Film thickness (μm) | Material | Film thickness (μm) | Life-time of plug (number of tubes made) | Piercing efficiency η(%) | Incidence ratio of inside surface defects (%) |
| 1 | Mo alloy | (Not formed) | Steel type A | 200 | 32 | 50 | 88 |

TABLE 2-continued

| Test No. | Plug front part: Material | Plug front part: Film thickness (μm) | Plug rear part: Material | Plug rear part: Film thickness (μm) | Investigation result after piercing: Life-time of plug (number of tubes made) | Investigation result after piercing: Piercing efficiency η(%) | Investigation result after piercing: Incidence ratio of inside surface defects (%) |
|---|---|---|---|---|---|---|---|
| 2 | Nb alloy | (Not formed) | Steel type B | 200 | 50 | 53 | 83 |
| 3 | SiC ceramic | (Not formed) | Steel type B | 200 | — | — | — |
| 4 | SiN ceramic | (Not formed) | Steel type A | 200 | — | — | — |
| 5 | Steel type A | 350 | Steel type B | 200 | 18 | 85 | 0 |
| 6 | Steel type A | 500 | Steel type A | 200 | 24 | 83 | 0 |
| 7 | Steel type B | 400 | Steel type A | 200 | 20 | 85 | 0 |
| 8 | Steel type A | 150 | Steel type A | 200 | 3 | 65 | 35 |

The life-time of low alloy steel plug shown in Table 2 was evaluated in consideration of the reuse of the low alloy steel plug by forming a scale by means of re-heat treatment. That is, the low alloy steel plug is reused by the re-heat treatment until the seizure and/or dissolution wastage is finally generated in the plug front part, or the plug surface is damaged, thereby causing the plug defects to be printed in the inner surface of the material to be rolled, whereby it is determined that the low alloy steel plug cannot be used any longer and at this point, the number of tubes made is regarded as the life-time of plug.

The piercing efficiency η shown in Table 2 is expressed by the following formula (1):

$$\eta = Vf/Vr \times 100(\%) \quad (1)$$

where $Vr = \pi \cdot D \cdot N/60 \times \sin\beta$,

Vf: workpiece velocity at exit (m/s),

Vr: axial direction component of a roll circumferential velocity in a roll gorge portion (m/s), D: roll gorge diameter (m), N: number of roll revolutions (rpm), and β: feed angle (°).

The generation of the inside surface defects is caused by the decrease in piercing efficiency η. A crumple is generated inside the material to be rolled due to the rotary forging effect (Mannesmann fracture effect) until the billet reaches the plug front end from onset engagement of the billet in the inclined rolls, and the crumple remains as the inside surface defects after the piercing/rolling. For example, when the coefficient of friction is increased in the plug, the number of rotary forging of the billet is increased until the billet reaches the front end of the plug from onset engagement of the billet in the inclined rolls, which causes the rotary forging effect (Mannesmann fracture effect) to be increased to likely generate the inside surface defects further.

As can be seen from Table 2, when the high alloy steel such as the Mo alloy and the Nb alloy is used for the front part of the split plug, the life-time of plug can largely be lengthened. However, because the coefficient of friction is increased, the piercing efficiency is largely decreased. Therefore, the number of rotary forging is increased until the billet reaches the front end of the plug from onset engagement of the billet in the inclined rolls, and the inside surface defects are likely generated. In particular, this remarkably emerges in the case where the material having a low deformability defects such as segregation and porosity in a central portion of the billet is pierced in a continuous cast round slab and the like.

On the other hand, when ceramic is used as the front part of the split plug, because ceramic is inferior in resistance to impact, the plug was broken from the front end portion in the piercing/rolling. Therefore, the investigation could not be performed after the piercing/rolling. According to the result shown in Table 2, even in the Cr—Ni low alloy steel plug, the heat insulating effect and lubricating effect can be secured during the piercing/rolling by forming the oxide film on the surface, so that the generation of the inside surface defects can be suppressed by avoiding the decrease in piercing efficiency so as to suppress the rotary forging effect.

In other words, in the split plug shown in Table 2, when the thickness of the oxide film formed in the front part of the Cr—Ni low alloy plug is increased, the life-time of plug can largely be lengthened. Simultaneously, the piercing efficiency can also largely be improved when compared with the Mo alloy or Nb alloy, so that the rotary forging effect can be suppressed to prevent the generation of the inside surface defects. However, as shown in Test No. 8, when the oxide film formed in the front part is relatively thinned, sometimes the lubricating ability is decreased to result in generating the inside surface defects. Accordingly, it is preferable to properly manage the thickness of the oxide film formed in the front part of the split plug.

(B) Appropriate Structure of Split Plug

The present inventors made various studies on the conventional split plug from the structure thereof. As a result, in the conventional split plug, it is found that the front part or rear part of the plug can be almost hardly replaced.

That is, in the conventional split plug, because only the plug front part is made of a high-strength material, first the plug front part and the plug rear part are independently made, and the plug front part and plug rear part are assembled using jointing means such as shrink fitting, press insert, and pressure welding. Accordingly, the plug front part and the plug rear part are rigidly jointed, the conventional split plug substantially has the same structure as the one-piece type plug during seamless tube making process in on-line operation, and actually the timing and method for replacing the plug and a life-time management method are similar to those of the one-piece type plug.

The present inventors focused on the fact that the durability of the plug front part or plug rear part can separately be managed to decrease the plug cost per production quantity when the plug front part and/or plug rear part is enabled to be replaced during seamless tube making process in on-line operation. For example, even if the plug front part in which the dissolution wastage is generated is replaced, the plug rear part can still be used, so that the total plug cost per production quantity can consequently be decreased. Therefore, for the plug structure, it is necessary to configure the structure in such a way that the mandrel bar holding the plug goes through the plug rear part and the mandrel bar is connected to the plug front part, wherein the split plug front part and plug rear part can be held as the integral plug and the plug front part and/or plug rear part can be easily removed.

The present invention is established based on the knowledge obtained in (A) and (B), and the summary of the present invention includes a seamless tube piercing/rolling plug of the following items (1) to (4), a seamless tube piercing/rolling apparatus of the following items (6) to (9), and a seamless tube of the following items (5) and (10).

(1) A seamless tube piercing/rolling plug in which a split plug composed of a plug front part and a plug rear part is used by holding the plug front part and plug rear part as an integral plug, characterized in that at least the plug front part is made of low alloy steel and oxide films are formed on surfaces of the plug front part and plug rear-part.

(2) It is preferable that a thickness of the oxide film formed on the surface of the plug front part be not less than 200 μm.

(3) It is preferable that that a thickness of the oxide film formed on the surface of the plug front part described in (1) or (2) be larger than a thickness of the oxide film formed on the surface of the plug rear part.

(4) It is preferable that tensile strength of the plug front part described in (1) or (2) be not lower than 50 MPa at 1100° C.

(5) A seamless tube producing method characterized in that an inclined rotary piercing mill pierces/rolls a solid billet heated to a predetermined temperature into a hollow shell while the plug described in (1) to (4) is used as a piercing/rolling tool.

(6) A seamless tube piercing/rolling apparatus in which a split plug composed of a plug front part and plug rear part is held as an integral plug, and the plug front part and/or plug rear part are removably mounted, characterized in that a mandrel bar holding the plug goes through the plug rear part and the mandrel bar is coupled with the plug front part.

(7) In the seamless tube piercing/rolling apparatus described in (6), it is preferable that a thickness of the oxide film formed in the plug front part be not less than 200 μm.

(8) In the seamless tube piercing/rolling apparatus described in (6) or (7), it is preferable that a scale thickness of the plug front part be larger than a scale thickness of the plug rear part.

(9) In the seamless tube piercing/rolling apparatus described in (6) to (8), it is preferable that tensile strength of the plug front part be not lower than 50 MPa at a temperature of 1100° C.

(10) A seamless tube producing method characterized in that the plug front part and/or plug rear part is replaced in a tube making process line using the producing apparatus described in (6) to (9).

The reason why "inclined rotary piercing mill" is used in the producing method of the present invention is that "inclined rotary piercing mill" is a typical rolling mill used in the Mannesmann tube making process, and the productivity is further improved while the hollow shell has the excellent quality after the rolling.

"The plug front part and/or plug rear part is replaced . . . in a tube making process line" shall mean that the plug replacement is performed in a mandrel bar circulation line when the mandrel bar supporting the plug is circularly used (bar circulation) in piercing the seamless tube. "The plug front part and/or plug rear part is replaced . . . in a tube making process line" shall also mean that the plug is replaced without stopping the apparatus for tube making or the plug is replaced during the operations of tube making process.

BRIEF DESCRIPTION OF THE DRAWINGS

FIG. 6 is a view showing a configuration example of a plug support section adopted in the present invention.

FIG. 8 is a view explaining a configuration of a plug support device used in the embodiment, FIG. 9 is a view explaining a configuration of a plug used in the embodiment.

BEST MODE FOR CARRYING OUT THE INVENTION

In the above inventions, the inventions concerning the split plug including the oxide film shown in (1) to (5) are mainly referred to as invention A, the inventions concerning the seamless tube piercing/rolling apparatus including the oxide film shown in (6) to (10) are mainly referred to as invention B, and best modes for carrying out the present inventions will be described below.

1. Mode for Carrying Out the Invention A (1) Best Mode of the Invention A

Figure 4:
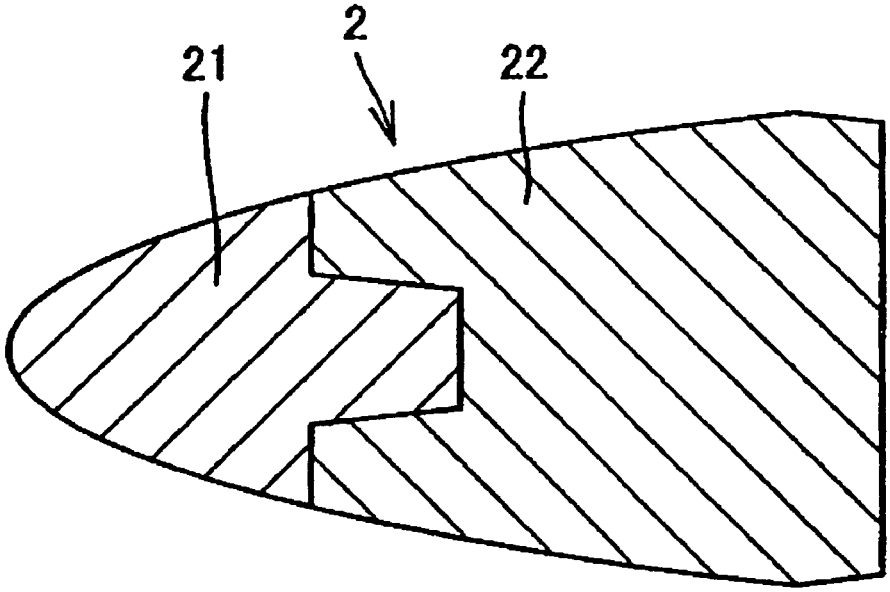
FIG. 4 is a front sectional view showing a configuration in a longitudinal direction of a split plug adopted in the present invention.

As shown in FIG. 4, a piercing/rolling plug of the invention A is a split plug 2 which is used while the split front part 21 and rear part 22 are jointed. The piercing/rolling plug of the invention A is characterized in that at least the front part 21 is made of low alloy steel and oxide films are formed on surfaces of the front part 21 and rear part 22. That is, the front part of the split plug is made of the low alloy steel, and the oxide films are formed on the surfaces of the front part 21 and rear part 22. Therefore, the hollow shell having excellent quality can be produced with high productivity while the required life-time of plug and plug cost per production quantity are ensured by maximally utilizing the heat insulating effect and lubricating ability which are exerted by the oxide film in the piercing/rolling.

Specifically, the temperature rise of the front part is particularly suppressed by utilizing the heat insulating effect of the oxide film formed on the plug surface, which allows the deformation of the whole plug to be prevented while effectively suppressing the generation of the dissolution wastage. The utilization of the lubricating ability of the oxide film avoids the decrease in piercing efficiency after the onset engagement of the billet in the inclined rolls, and the generation of the inside surface defects can be prevented by suppressing rotary forging effect (Mannesmann fracture effect).

Therefore, even if the low alloy steel plug has the inexpensive material unit cost, the required life-time of plug can be achieved. Furthermore, when compared with the Mo alloy or Nb alloy, the piercing efficiency can remarkably be improved and the inside surface defects generated in the hollow shell can be prevented.

3% Cr-1% Ni steel can be cited as an example of the low alloy steel which is of a target of the present invention, because the oxide film having good adhesion property is desirably formed on the surface. However, the low alloy steel is not limited to 3% Cr-1% Ni steel. For example, the front part and rear part of the split plug may be made of low alloy steel containing Cr: 0.2 to 5.0% and/or Ni: 0.2 to 7.0% in terms of mass %. For example, in the plug rear part, low alloy steel which does not contain Cr and Ni but contains other alloy components may be used as long as a predetermined oxide film is formed on the surface of the plug rear part.

In the piercing/rolling plug of the present invention, the material of the front part is limited to low alloy steel, while the material of the rear part is not limited to low alloy steel. Accordingly, the material of the rear part can be selected according to the piercing conditions as long as the predetermined oxide film is formed on the surface of the rear part. The oxide film of the plug surface can be formed by placing the plug into the heating furnace in the oxidizing atmosphere to perform the heat treatment. At this point, the thickness of the oxide film can be adjusted by heat treatment conditions. Therefore, in the case where the split plug is adopted, the films having predetermined thicknesses can be evenly formed by separately performing the heat treatment for the front part and the rear part respectively.

As described above, the oxide film formed on the surface of the plug front part can exert the heat insulating effect and the lubricating ability during the piercing/rolling, so that the long life-time of plug can be achieved even in the inexpensive plug. However, when the thickness of the oxide film is excessively decreased, sometimes the desired lubricating ability cannot be exerted, so that it is preferable that the thickness of the oxide film formed in the front part be not less than 200 μm.

On the other hand, when the piercing is performed while the oxide film is thick in the plug rear part, the oxide film partially comes off to degrade the surface quality of the plug, thereby degrading the surface quality of the inner surface of the hollow shell after the rolling, which results in the frequent generation of the minute seam defects in a rice grain form in the inner surface of the hollow shell after the final finishing rolling. Therefore, in the piercing/rolling plug of the present invention, it is preferable that the thickness of the oxide film formed in the front part be larger than that of the oxide film formed in the rear part. This is because the generation of the minute seam defects in a rice grain form after the finish rolling can be suppressed without decreasing the life-time of plug.

In the conventional one-piece type plug, it takes a long time for the grinding work to thin the oxide film, formed in the whole surface of the plug, only in the rear part. On the contrary, in the present invention, because the split plug is adopted, the even oxide film can separately be formed in the front part and the rear part, and the oxide film can efficiently be formed on the plug surface.

In the split plug adopted in the present invention, the method of jointing the front part and the rear part is not limited, but any conventional method can be used as the method of jointing the front part and the rear part. For example, the shrink fitting method, the press insert method, the pressure welding method, the adhesive bonding method, and the screw thread method may be used for jointing. When the piercing/rolling plug of the present invention is adopted, the materials of the front part and the rear part can be selected according to the front part function and the rear part function of the split plug respectively, and the combination of the material for the front part and that for the rear part can be selected as appropriate. Further, the thickness of the film can evenly be formed according to the function by adjusting the heat treatment conditions of the oxide film. Therefore, a degree of freedom is dramatically spread on material design of each part in the split plug.

As described above, according to the piercing/rolling plug of the present invention, the oxide film having the even thickness can appropriately be formed in each surface of the front part and rear part of the split plug. Accordingly, the dissolution wastage generated in the front part can be suppressed to prevent the degradation of the quality of the inner surface of the hollow shell after the rolling, and thereby the generation of the minute crack can be suppressed after the finish rolling. Furthermore, in the piercing/rolling, the decrease in piercing efficiency is avoided to suppress the rotary forging effect (Mannesmann fracture effect), so that the generation of the inside surface defects can be prevented.

Additionally, when the piercing/rolling plug of the present invention is used as the tool for piercing/rolling, the hollow shell having the excellent quality can efficiently be produced while the life-time of plug is largely improved. Because the front part of the piercing/rolling plug of the present invention is made of low alloy steel, the front part of the piercing/rolling plug can be made by the casting in the atmosphere. Even if the plug is scrapped, the material cost can be brought down. The scrap region is limited only to the front part whose volume is small, so that the plug cost per production quantity can remarkably be reduced.

(2) Embodiment of the Invention A

Figure 1:
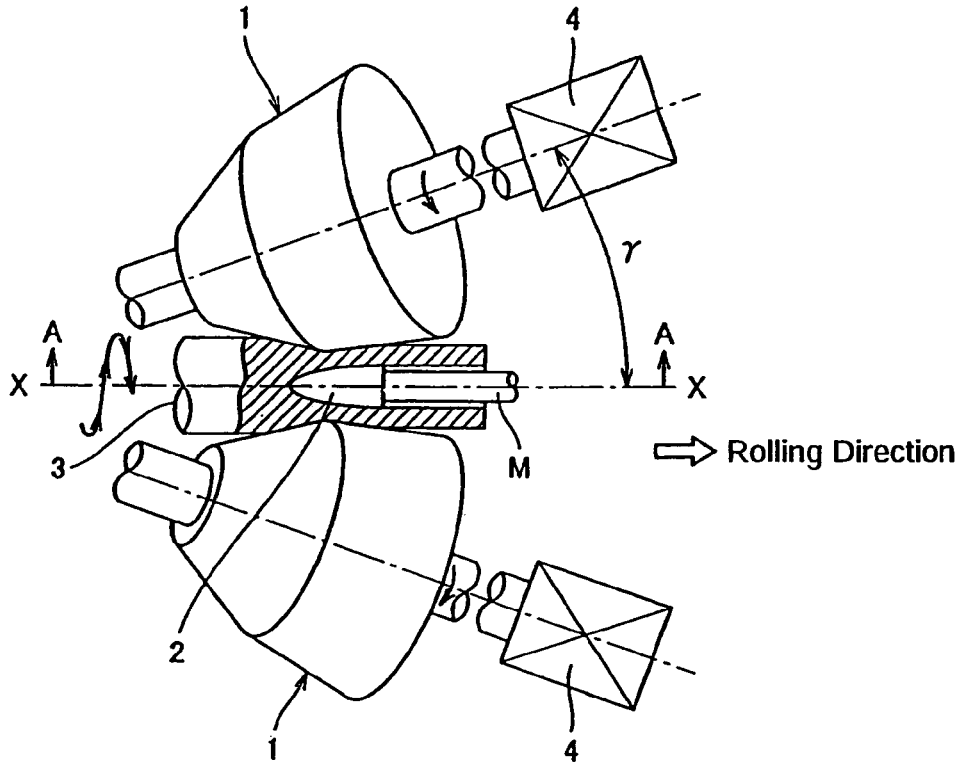
FIG. 1 is a view schematically explaining an arrangement of cone-shape inclined rolls used in piercing.
Figure 2:
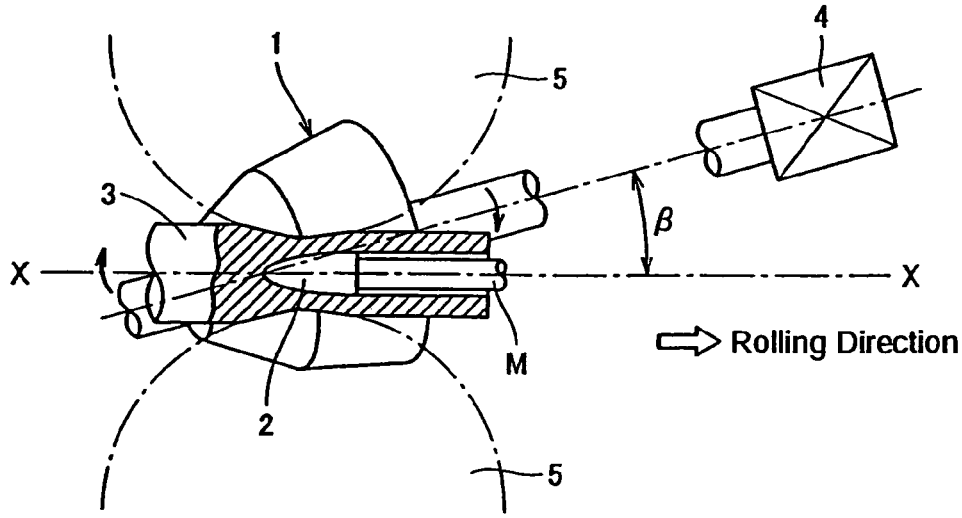
FIG. 2 is a view explaining the arrangement of cone-shape inclined rolls shown by an arrow A-A of FIG. 1.
Figure 3:
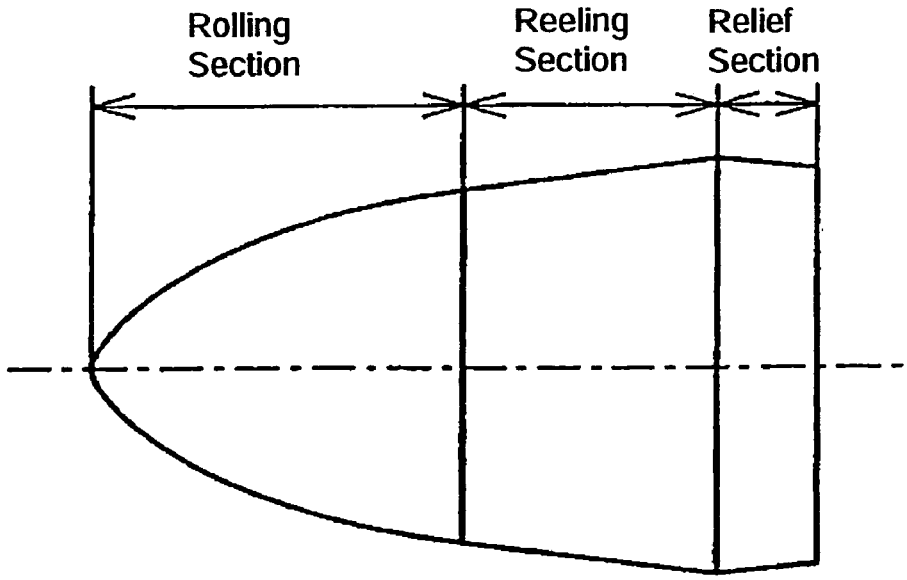
FIG. 3 is a view showing an outer contour profile in a longitudinal direction of a plug adopted as a tool for piercing/rolling.
Figure 5:
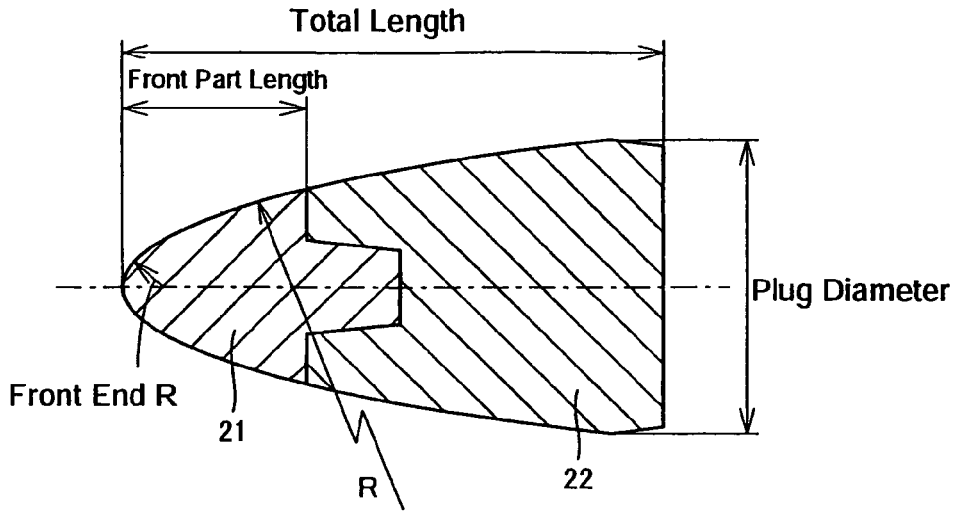
FIG. 5 is a front sectional view showing a configuration in a longitudinal direction of a split plug adopted in an embodiment.

A piercing test was performed with the piercing/rolling plug of the invention A in order to confirm the effect of the invention A. The test was performed with the inclined piercer shown in FIG. 1 while the cross angle γ was set to 10° and the feed angle β was set to 10°. FIG. 5 is a front sectional view showing a configuration in a lengthwise direction of the split plug used in the embodiment. The front part 21 and rear part 22 of the split plug were formed in combination of three steel types C to E whose chemical compositions are shown in Table 3.

TABLE 3

| | Chemical compositions (mass %, the remainder includes Fe and unavoidable impurities) | | | | |
|---|---|---|---|---|---|
| Steel type | C | Cr | Ni | W | Mo |
| C | 0.15 | 0.52 | 1.10 | 3.03 | 2.0 |
| D | 0.28 | — | 1.63 | 2.3 | 2.4 |
| E | 0.25 | 3.05 | 1.01 | — | — |

In order to vary the thickness of the oxide film formed on the plug surface in the range of 150 to 500 μm, the front part 21 and the rear part 22 were separately treated in the heating furnace with the oxidizing atmosphere to perform the heat treatment. Specifically, the front part 21 and the rear part 22 were put into the heating furnace in the oxidizing atmosphere in which a concentration of water steam was not lower than 14 volume %, and the heat treatment was performed to the front part and the rear part. In the heat treatment, the front part 21 and the rear part 22 were evenly held for six hours in the temperature range of 980 to 1100° C., and the front part 21 and the rear part 22 were gradually cooled to 800° C. at a cooling rate of 50° C./hr.

As shown in FIG. 5, the front part 21 and rear part 22 in which the oxide film were formed were jointed by the screw thread method, and the cannon ball type split plug was made such that a length of the plug front part accounted for 24% of the total length of the plug. SUS304 stainless steel was used as the sample material, the billet having the outer diameter of 187 mm×length of 1500 mm was heated to 1250° C., and the piercing/rolling was performed with various split plugs shown in Table 4 to obtain the hollow shell having the outer diameter of 196 mm. First, the life-time of plug was investigated.

Then, elongation/rolling was performed with the Mandrel mill, and the reducer mill is applied to obtain the finished mother tube having the outer diameter of 73 mm×thickness of 6.2 mm. Then, the incidence ratio of the inside surface defects was investigated in the mother tube. Table 4 shows the plug conditions used in the test and the investigation results of the life-time of plug after the piercing/rolling and the incidence ratio of the inside surface defects.

2. Mode for Carrying Out the Invention B (1) Best Mode of the Invention B

A seamless tube piercing/rolling apparatus in which a split plug composed of a plug front part and plug rear part is held as an integral plug, and the plug front part and/or plug rear part is removably mounted, the seamless tube piercing/rolling apparatus is characterized in that an mandrel bar holding the plug goes through the plug rear part and the mandrel bar is coupled with the plug front part.

As described above, in the conventional split plug, the plug front part in which the dissolution wastage is likely generated cannot be replaced or the plug rear part cannot solely be exchanged. Therefore, although the plug front part and the plug rear part are made while separated, actually the timing and method for replacing the plug and the life-time management are similar to those of the one-piece type plug.

In the seamless tube piercing/rolling apparatus of the present invention, in order that the plug front part or plug rear part is mounted to enable independent removal, or in order that the plug front part and plug rear part are mounted to enable joint removal, the plug front part and plug rear part adopt the structure in which the plug front part and the plug rear part are assembled without using the jointing means such as the shrink fitting, the press insert, and the pressure welding, and the mandrel bar goes through the plug rear part and the mandrel bar is coupled with the plug front part. At this point, the separated plug front part and plug rear part are configured to be independently rotatable while held as the integral plug.

TABLE 4

| | Plug front part | | Plug rear part | | Piercing | Finish rolling | |
|---|---|---|---|---|---|---|---|
| Production No. | Steel Type | Film thickness (μm) | Steel Type | Film thickness (μm) | Life-time of plug (number of tubes made) | Incidence ratio of inside surface defects (%) | Classification |
| 1 | Steel type D | 150 | Steel type C | 200 | 3 | 30 | Inventive example |
| 2 | Steel type C | 200 | Steel type D | 200 | 12 | 0 | |
| 3 | Steel type E | 400 | Steel type D | 200 | 32 | 0 | |
| 4 | Steel type C | 400 | Steel type C | 250 | 34 | 0 | |
| 5 | Steel type D | 300 | Steel type E | 200 | 26 | 0 | |

The inside surface defects shown in Table 4 include both the inside surface defects caused by the rotary forging effect and the minute seam defects in a rice grain form caused by the surface roughness of the plug. The incidence ratio of the inside surface defects is a ratio of the number of tubes in which the inside surface defects were generated with respect to 100 tubes to which the piercing/rolling was attempted. As shown in Table 4, in all the split plugs used in the embodiment, the front part is made of the low alloy steel, and the oxide films are formed on the plug surfaces of the front part and rear part. Therefore, all the split plugs shown in Table 4 are the piercing/rolling plug of Inventive example.

In the piercing/rolling plugs of Inventive example, as shown in the production Nos. 2 to 5, the inside surface defects generated after the finish rolling can be eliminated in the piercing/rolling plug in which the thickness of the oxide film formed on the front part is not less than 200 μm.

Unlike the conventional split plug, the failure can be prevented by adopting the above configuration in the joint portion of the plug front part and the plug rear part. Further, a supporting mechanism by the mandrel rod can be a simple structure, which is not a factor of increasing the production cost of seamless tubes.

In the seamless tube piercing/rolling apparatus of the present invention, the plug front part and/or plug rear part can be replaced during seamless tube making process in on-line operation, and it is not necessary to stop the tube making apparatus for the purpose of replacing the plug.

In replacing the plug front part, it is not always necessary that the high strength material be selected as the plug front part. For example, the plug front part is made of Cr—Ni low alloy steel and the plug front part is appropriately replaced, and thereby the plug expense may be reduced. Alternatively, the plug front part may be made of high strength material to achieve the extension of the life-time of plug or the improvement of the tube making efficiency.

Figure 6A:
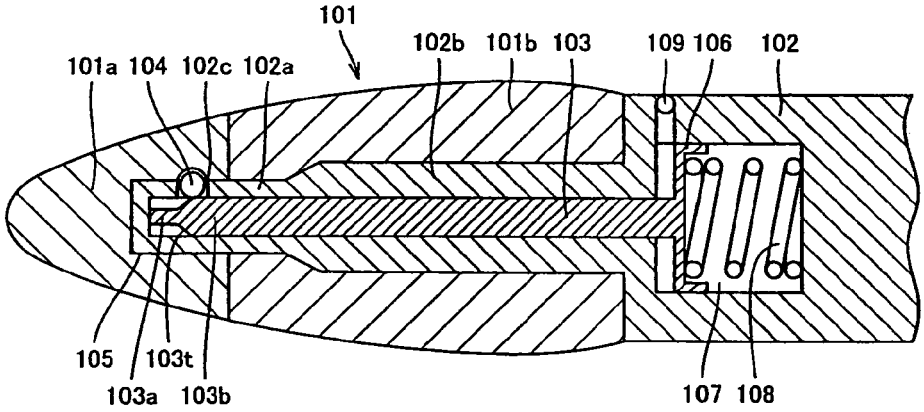
FIG. 6A shows a state in which a mandrel bar supports a plug front part and a plug rear part as an integral plug.
Figure 6B:
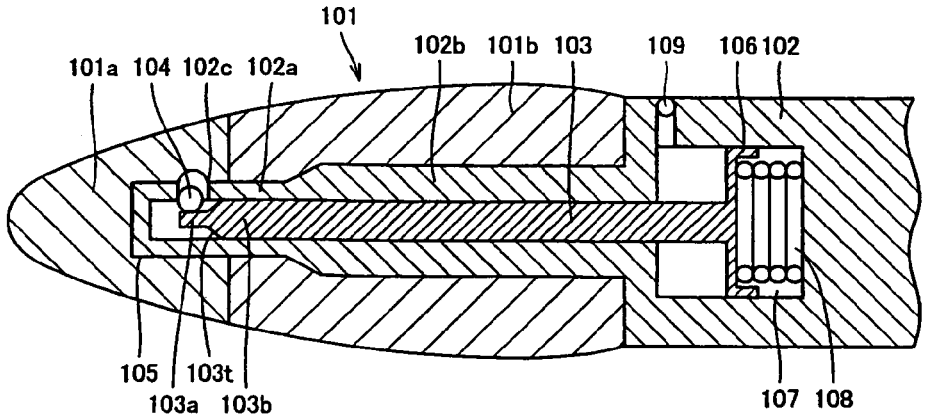
FIG. 6B shows a state in which the mandrel bar releases the support of the plug.

FIG. 6 is a view showing a configuration example of a plug support section adopted in the producing apparatus of the present invention, FIG. 6A shows a state in which the mandrel bar supports a plug front part and a plug rear part as the integral plug, and FIG. 6B shows a state in which the mandrel bar releases the support of the plug. However, in the structure of the plug support part shown in FIG. 6, the support structure is illustrated by way of example, and the apparatus structure of the present invention is not limited to the structure shown in FIG. 6.

In a plug 101 which is of a target of the present invention, a plug front part 101*a* and a plug rear part 101*b* are physically separated, and the plug front part 101*a* and the plug rear part 101*b* are held as the integral plug 101 by an mandrel bar 102 in the piercing/rolling. In order that the plug front part 101*a* and the plug rear part 101*b* are rotatable and removably mounted, the front end of the mandrel bar 102 is configured to go through the plug rear part 101*b* and is coupled with the plug front part 101*a*.

The front end of the mandrel bar 102 has a two-step structure including a mandrel bar small-diameter part 102*a* and a mandrel bar large-diameter part 102*b*. The mandrel bar large-diameter part 102*b* goes through the plug rear part 101*b*, and the mandrel bar small-diameter part 102*a* is fitted to an inner peripheral hole 105 of the plug front part 101*a* so as to be rotatably coupled with the inner peripheral hole 105. A through hole 102*c* is provided in the mandrel bar small-diameter part 102*a*, and a steel ball 104 is accommodated in the through hole 102*c* so as to be projected from the front outer peripheral surface of the mandrel bar 102 in order to prevent a release of the plug front part 101*a* from the mandrel bar 102. When the steel ball 104 is projected at the maximum, a part of the steel ball 104 protrudes from the outer peripheral surface of the mandrel bar to be fitted in a recess provided onto the inner surface of the peripheral hole 105 of the plug front part 101*a*, which allows the plug front part 101*a* to be securely supported.

A sliding rod 103 is inserted into the inner surface of the front end of the mandrel bar 102, and the sliding rod 103 includes a large-diameter parallel part 103*b*, a tapered part 103*t*, and a small-diameter parallel part 103*a*. As shown in FIG. 6A, when the sliding rod 103 is located at a forward limit position, the steel ball 104 is pushed up by the large-diameter parallel part 103*b*, and the steel ball 104 is projected at the maximum from the outer peripheral surface of the mandrel bar 102. On the other hand, as shown in FIG. 6B, when the sliding rod 103 is located at a backward limit position, the steel ball 104 is supported by the small-diameter parallel part 103*a*, and the steel ball 104 is accommodated in the right position of the inner surface of the front end of the mandrel bar 102.

A piston 106 is provided at a rear end of the sliding rod 103, and the piston 106 is accommodated in a sliding hole 107 made in the mandrel bar. The piston 106 is pressed toward the front-end direction of the mandrel bar 102 by a spring 108 provided at the back of the piston 106 in the sliding hole 107, and the sliding rod 103 is located at the forward limit position. In the above structure of the plug support part, when the plug 101 is attached and supported, high-pressure air is supplied from an air supply port 109 to move the piston 106 rearward against the pressing force of the spring 108, and sliding rod 103 is caused to recede.

When the sliding rod 103 is moved to the rearward limit position, the steel ball 104 is accommodated in the right position of the inner surface of the front end of the mandrel bar 102, and the plug front part 101*a* and the plug rear part 101*b* are enabled to be freely handled. Even if the sliding rod 103 is moved to the rearward limit position, because the steel ball 104 is held by the small-diameter parallel part 103*a*, the steel ball 104 never drops off in the inner surface of the mandrel bar 102.

When the plug front part 101*a* and the plug rear part 101*b* are attached, the supply of the high-pressure air is stopped, which moves the sliding rod 103 to the forward limit position. As the sliding rod 103 is moved forward, the steel ball 104 is gradually pushed up and the pushed out to the outside of the mandrel bar 102 by the tapered part 103*t*. A part of the pushed-out steel ball 104 is fitted in the recess provided onto the inner surface of the inner peripheral hole 105 of the plug front part 101*a*. Then, the sliding rod 103 is located at the forward limit position, and the plug 101 is supported by the mandrel bar 102 while the steel ball 104 is supported by the large-diameter parallel part 103*b*.

In the case where the plug 101 is replaced, as with the case where the plug 101 is attached and supported, the high-pressure air is supplied from the air supply port 109 to move the piston 106 rearward against the pressing force of the spring 108, and sliding rod 103 is caused to recede to the rearward limit position. Therefore, the steel ball 104 is accommodated in the right position of the inner surface of the front end of the mandrel bar 102, and the plug front part 101*a* and the plug rear part 101*b* are enabled to be appropriately detached.

In the configuration example of FIG. 6, only one steel ball 104 is shown. Although the attachment and support of the plug 101 can sufficiently be achieved even in the configuration example of FIG. 6, it is preferable that plural steel balls be arranged at equal intervals in the circumferential direction.

As described above, in order to obtain the heat insulating effect and the lubricating effect in the piercing/rolling, it is preferable that the scale having the thickness of 200 to 1000 μm be generated on the plug surface. At this point, in order to decrease the hollow shell inside surface defects generated after the piercing/rolling without shortening the life-time of plug, it is recognized that the scale film having the even thickness is not formed on the whole surface of the plug, but desirably the thickness of the scale film formed in the plug front part is larger than that of the plug rear part.

Accordingly, in the seamless tube piercing/rolling apparatus of the present invention, it is also preferable that the scale thickness of the plug front part be larger than that of the plug rear part. The man-hour, for which the relatively thick scale formed on the whole surface of the plug is ground and thinned only in the plug rear part, is particularly required in the conventional one-piece type plug. On the contrary, the plug of the present invention is effective because the plug front part and the plug rear part can separately be formed.

When the sharp-nosed plug front part is formed, the roll onset engagement characteristic is improved. At the same time, the dissolution wastage is likely generated in the plug front part as the heat capacity is decreased. However, when the predetermined high-temperature strength can be ensured in the plug front part, the piercing/rolling can efficiently be performed without the dissolution wastage.

Specifically, in the seamless tube piercing/rolling apparatus of the present invention, it is preferable that tensile strength of the plug front part be not lower than 50 MPa at 1100° C. The target temperature of 1100° C. is the maximum temperature at which the plug front part can reach in the piecing/rolling. The reason why the strength required at this point is set to 50 MPa or more is that 1.2 to 2.0 times the tensile strength of the plug front part is required compared with the tensile strength at 1100° C. of 3% Cr-1% Ni steel which is usually used as the plug material.

(2) Embodiment of the Invention B

The piercing test was performed with the producing apparatus of the invention B in order to confirm the effect of the invention B. The test material was martensitic stainless steel containing 13%-Cr, the billet having the outer diameter of 187 mm was heated to 1220° C., and the billet was pierced/rolled to obtain the hollow shell having the outer diameter of 196 mm.

is used, and the mandrel bar 102 is inserted into the inner peripheral hole of the plug rear part to support the whole of the plug 101. The plug 101 was made of 3.0% Cr-1.0% Ni steel, and the scale having the thickness of 500 μm was generated on the surface of the plug 101.

In the embodiment, the outline sizes of the plugs used were similar to one another, the piercing/rolling was performed to each plug up to 10 passes until the trouble was generated in the rolling, and the surface state of the plug was observed. Table 5 shows the results.

TABLE 5

| | | Conditions of plug front part or integral plug (Comparative example 2) | | | | Result of piercing | |
|---|---|---|---|---|---|---|---|
| Classification | Plug No. | Front part length ratio (%) | Material (*) | Tensile strength (1100° C.: MPa) | Scale thickness (μm) | Number of tubes made | Surface state of plug |
| Inventive example | 101 | 18 | 3.0Cr—1.0Ni | 30 | 500 | 1 | Front part dissolution wastage |
| | 102 | 18 | 3.0Cr—1.0Ni | 30 | 1500 | 2 | Gorge corresponding position dissolution wastage |
| | 103 | 18 | 0.5Cr—1.5Mo—3.0W | 55 | 500 | 2 | Front part dissolution wastage, gorge corresponding position dissolution wastage |
| | 104 | 36 | 0.5Cr—1.5Mo—3.0W | 55 | 500 | 3 | Front part dissolution wastage |
| | 105 | 36 | 0.5Cr—1.5Mo—3.0W | 55 | 1500 | 5 | Front part dissolution wastage |
| Com. exam 1 | 106 | 36 | Nb alloy | >100 | 500 | 4 | Front part drops off from rear part |
| Com. exam 2 | 107 | — | 3.0Cr—1.0Ni | 30 | 500 | 1 | Front part dissolution wastage |

(*) The material in Table 5 shows 3.0Cr—1.0Ni steel and 0.5Cr—1.5Mo—3.0W steel.
The front part length ratio indicates a ratio (%) of the plug front part length to the plug total length.

Figure 7:
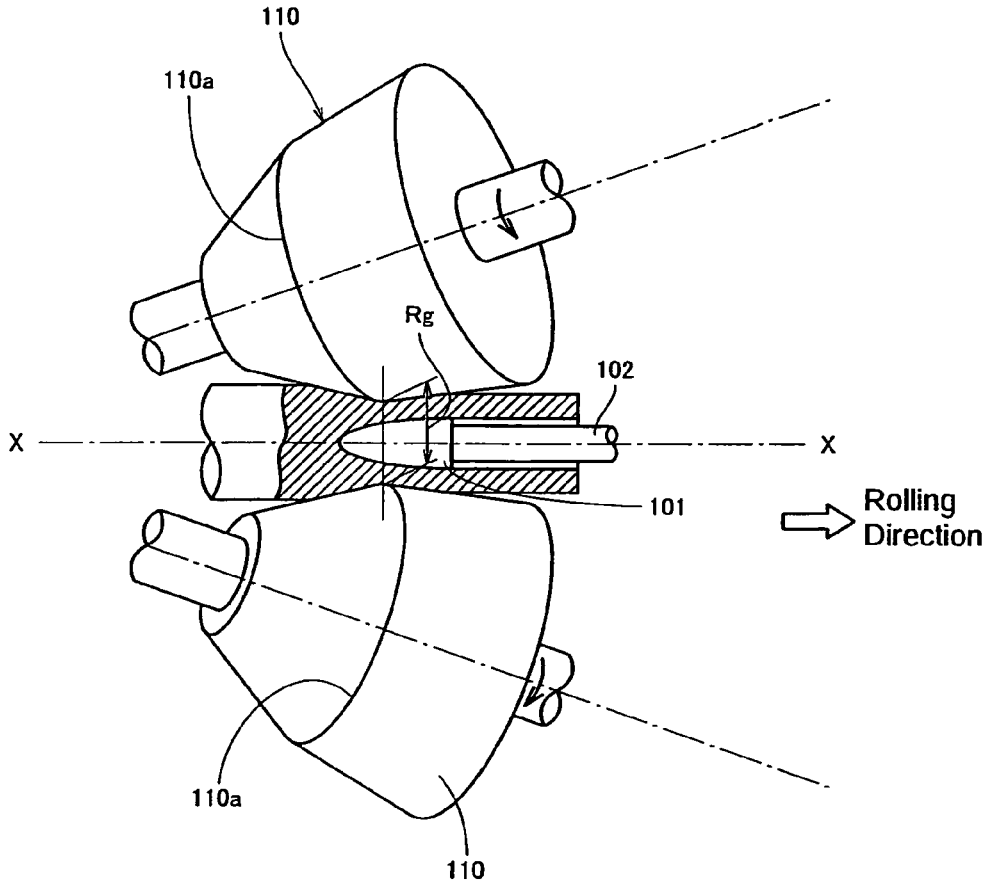
FIG. 7 is a view showing an arrangement of a pair of piercing rolls opposing to each other and a plug in order to pierce a billet.

FIG. 7 is a view explaining an arrangement of the pair of piercing rolls opposing to each other and the plug in order to pierce the billet. A gorge portion 110*a* of a piercing roll 110 is located at a position, where an inlet surface and an outlet surface of the piercing roll 110 intersect each other and a gap between the pair of piercing rolls 110 and 110 becomes the minimum. A roll distance Rg (mm) is the gap at the position of the gorge portion 110*a*.

The piercing roll is arranged with the feed angle β (°). In the embodiment, the piercing/rolling was performed under the following conditions:

Roll distance Rg: 162 mm, and feed angle β: 12°.

Figure 8A:
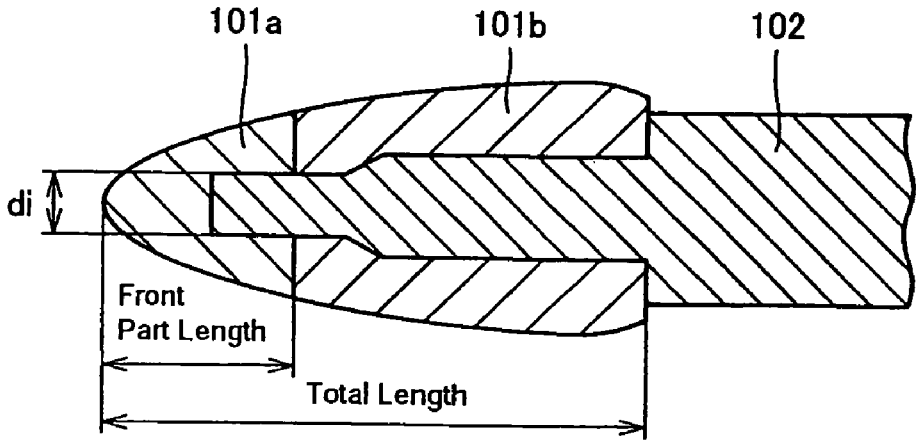
FIG. 8A shows an inventive example.

FIG. 8 is a view explaining a configuration of a plug support device used in the embodiment. FIG. 8A shows an Inventive example. In FIG. 8A, the mandrel bar 102 goes through the plug rear part 101*b* to hold the split plug front part 101*a* and plug rear part 101*b* as the integral plug 101. The plug rear part 101*b* was made of 3.0% Cr-1.0% Ni steel, and the scale having the thickness of 500 μm was generated on the surface of the plug rear part 101*b*. The length of the plug front part 101*a* was varied in two levels while the material of the plug front part 101*a* was varied. At the same time, a hole diameter di of the inner peripheral hole was varied in the range of 20 to 30 mm.

Figure 8B:
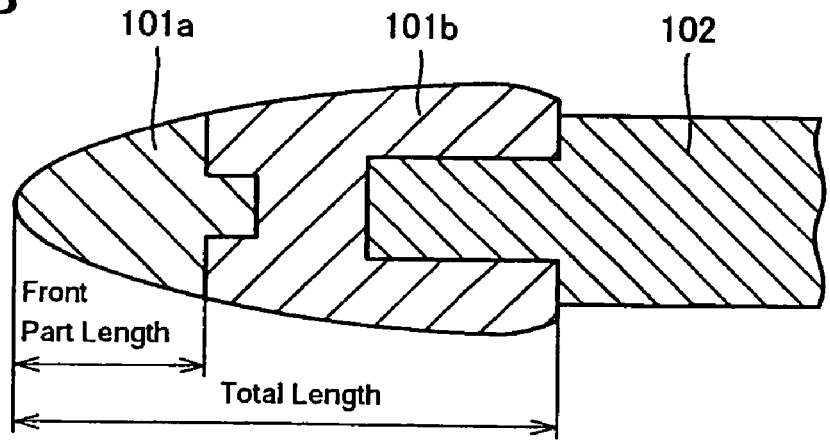
FIGS. 8B and 8C show a comparative example.
Figure 8C:
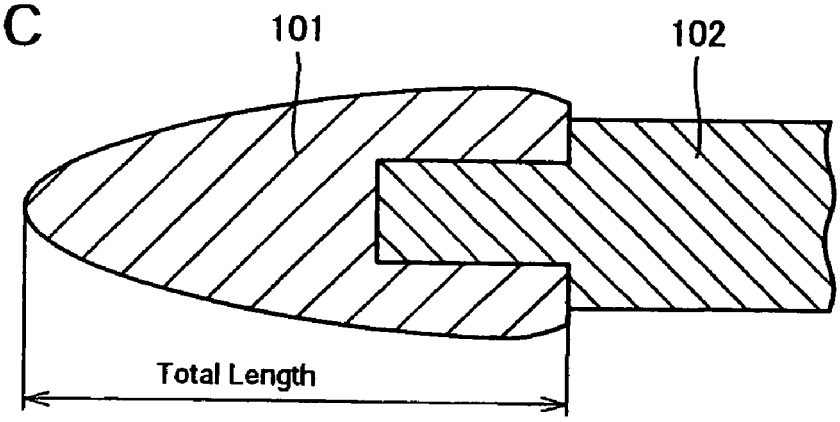

FIG. 8B shows Comparative Example 1, the plug front part 101*a* and the plug rear part 101*b* are jointed by the shrink fitting, and the mandrel bar 102 is inserted into the inner peripheral hole of the plug rear part 101*b* to support the whole of the plug 101. The plug rear part 101*b* was made of 3.0% Cr-1.0% Ni steel, the scale having the thickness of 500 μm was generated on the surface of the plug rear part 101*b*, and the plug front part 101*a* was made of the Nb alloy. FIG. 8C shows Comparative Example 2, the one-piece type plug 101

As shown in Table 5, in the plug No. 106 of Comparative example 1, because the joint between the plug front part and the rear part dropped off by four passes, it was necessary to stop the rolling, and the original performance of the split plug in which the plug front part was made of high strength material was not exerted. On the other hand, in the plug No. 107 of Comparative example 2, the dissolution wastage was generated to end the life-time of plug by one pass in the plug front part.

The plug No. 101 of Inventive example was made of the same material as the plug No. 107, and similarly the dissolution wastage was generated by one pass in the plug front part. However, only the plug front part was able to be replaced, so that a scrap weight ratio became one quarter or less.

In the plug No. 102 of Inventive example, because the scale was thickened in the plug front part, the life-time of plug was doubled compared with the plug No. 101. In order to form the thick scale of the plug No. 102, the duration of the plug heat treatment is lengthened, or the heat treatment temperature is raised by tens degrees. When the heat treatment is performed for a large amount of plugs, the cost increase associated with the plug heat treatment can be absorbed. Therefore, in the plug No. 102 of Inventive example, the plug cost per production quantity was reduced to about a half compared with the plug No. 101 and to about one-eighths compared with the plug No. 107 of Comparative example 2.

In the plug No. 103 of Inventive example, because the plug front part was made of the strength material of 0.5% Cr-1.5% Mo-3.0% W steel, when compared with the plug No. 101, the plug cost per production quantity became about 1.5 folds while the life-time of plug was doubled. That is, even if the plug cost per production quantity is increased by using the high strength material for the plug front part, only the plug front part is replaced, and the hardly broken plug rear part is made of a low-cost material, which allows the plug cost per production quantity to be further reduced.

In the plug No. 104 of Inventive example, because the dissolution wastage point was shifted from the plug front part to the gorge corresponding position (namely, position in the plug longitudinal direction corresponding to the roll gorge portion in setting the plug in the mill) in the plug No. 103, the length of the plug front part was extended to the gorge corresponding position, and thereby the dissolution wastage was suppressed at the gorge corresponding position to further improve the life-time of plug. In the plug No. 105 of Inventive example, the scale was formed heavily compared with the plug No. 104, so that the life-time of plug was improved.

Another piercing test was performed with the producing apparatus of the invention B in order to further confirm the effect of the invention B. The test material was SUS304, the billet having the outer diameter of 65 mm was heated to 1200° C., and the billet was pierced/rolled to obtain the hollow shell having the outer diameter of 87 mm. In the embodiment, the piercing/rolling was performed under the following conditions:

Roll distance Rg: 57.2 mm, and feed angle β: 10°.

Figure 9A:
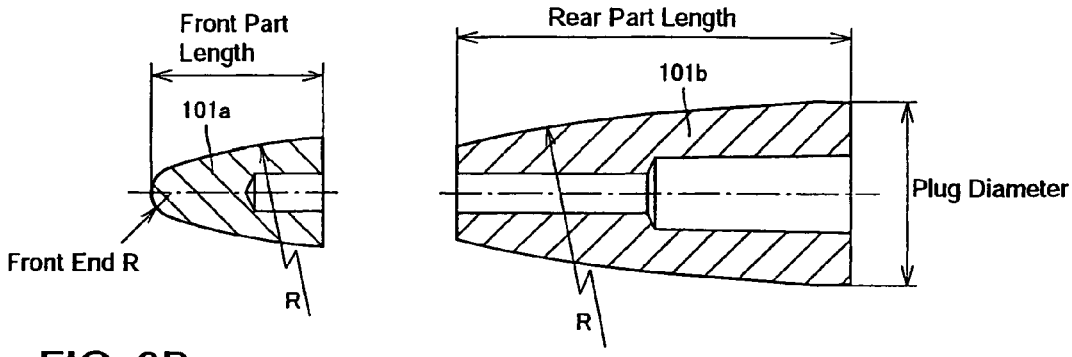
FIG. 9A shows an inventive example.
Figure 9B:
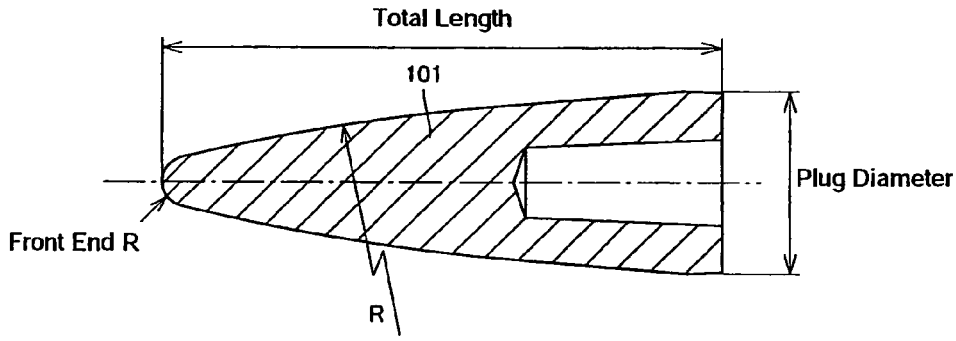
FIG. 9B shows a comparative example.

FIG. 9 is a view explaining a configuration of the plug used in Inventive example. FIG. 9A shows Inventive example, the length of the plug front part 101*a* was set to 24% of the plug total length, the plug rear part 101*b* was made of 3.0% Cr-1.0% Ni steel, and the scale having the thickness of 500 μm was generated on the surface of the plug rear part 101*b*. FIG. 9B shows the one-piece type plug which is of Comparative example, the one-piece type plug was made of 3.0% Cr-1.0% Ni steel, and the scale having the thickness of 500 μm was generated on the surface of the one-piece type plug.

In the embodiment the piercing/rolling was performed up to 20 passes, and the surface state of the plug was observed. Table 6 shows the results.

TABLE 6

| | | Conditions of plug front part or integral plug | | Result of piercing. | |
|---|---|---|---|---|---|
| Classification | Plug No. | Material | Scale thickness (μm) | Number of tubes made | Surface state of plug |
| Inventive examplie | 111 | 3.0Cr—1.0Ni | 500 | 1 | Front part dissolution wastage, gorge corresponding position dissolution wastage |
| | 112 | 3.0Cr—1.0Ni | 1500 | 2 | Front part dissolution wastage |
| | 113 | 0.5Cr—1.5Mo—3.0W | 500 | 2 | Front part dissolution wastage |
| | 114 | 0.5Cr—1.5Mo—3.0W | 1500 | 3 | Front part dissolution wastage |
| Comparative examplie | 115 | 3.0Cr—1.0Ni | 500 | 1 | Front part dissolution wastage, gorge corresponding position dissolution wastage |

As shown in Table 6, in the plug No. 111 of Inventive example in which the plug front part 101*a* was made of the same material as the plug No. 115 of Comparative example, the dissolution wastage was generated to end the life-time of plug by one pass like Comparative example. However, in the plug No. 111, only the plug front part was able to be replaced, so that the scrap weight ratio was about one-tenths.

In the plug No. 112 of Inventive example, because the scale thickness was larger than that of plug No. 111, and the life-time of plug was doubled compared with the plug No. 111. The material having the high-temperature strength higher than that of the plug No. 111 was used in the plug No. 113, so that the life-time of plug was doubled even if the scale thickness was similar to that of the plug No. 111. In the plug No. 114, the same material as the plug No. 113 was used, and the scale thickness was larger than that of the plug No. 113. The life-time of plug of the plug No. 114 became 1.5 folds compared with the plug No. 113.

INDUSTRIAL APPLICABILITY

According to the seamless tube piercing/rolling plug of the present invention, even if the stainless steel or high alloy steel is pierced/rolled, the minute seam defects in a rice grain form caused by the oxide film on the plug surface can be eliminated, the generation of the inside surface defects caused by the rotary forging effect (Mannesmann fracture effect) during engaging the material to be rolled in the inclined rolls can be prevented without decreasing the piercing efficiency of the material to be rolled. Furthermore, according to the seamless tube piercing/rolling apparatus of the present invention, the plug front part and/or the plug rear part can be replaced without generating the trouble in jointing the split plugs during seamless tube making process in on-line operation.

Accordingly, when the present invention is applied, the extension of the life-time of plug and the excellent plug cost per production quantity can be achieved. Additionally, in replacing the plug front part, the plug expense can be reduced by using low alloy steel for the plug front part. Furthermore, the plug front part is made of the high-strength material, and thereby the extension of plug life-time and the improvement of the pipe producing efficiency can be achieved. Because the hollow shell having the excellent quality can efficiently be produced by applying the present invention to the inclined rotary piercing mill, the present invention can widely be adopted to optimally produce the seamless tube in the actual operation.

What is claimed is:

1. A seamless tube piercing/rolling plug in which a split plug composed of a plug front part and plug rear part is used by holding the plug front part and plug rear part as an integral plug by means of a mandrel bar going through the plug rear part, wherein said plug front part and plug rear part are replaceable and independently rotatable about a centerline axis thereof without generating any trouble jointing said plug parts into the complete split plug during a seamless tube making process in on-line operation;

said plug front part is made in a one-piece structure and diameters thereof continuously and smoothly progressively increase as they go from a front end to a rear end;

a front end portion of said plug front part does not have an opening lest the mandrel bar should go through and stick out when said plug front part and said plug rear part are held as the integral plug; and at least said plug front part is made of low alloy steel and oxide films are formed on surfaces of the plug front part and plug rear part.

2. A seamless tube piercing/rolling plug according to claim 1, wherein a thickness of the oxide film formed in said plug front part is not less than 200 μm.

3. A seamless tube piercing/rolling plug according to claim 1, wherein a thickness of the oxide film formed in said plug front part is larger than a thickness of the oxide film formed in said plug rear part.

4. A seamless tube piercing/rolling plug according to claim 1, wherein tensile strength of said plug front part is not lower than 50 MPa at 1100° C.

5. A seamless tube producing method wherein an inclined rotary piercing mill pierces/rolls a billet heated to a predetermined temperature into a hollow shell while the plug according to claim 1 is used as a piercing tool.

6. A seamless tube producing method wherein an inclined rotary piercing mill pierces a billet heated to a predetermined temperature into a hollow shell while the plug according to claim 3 is used as a piercing tool.

7. A seamless tube piercing/rolling plug according to claim 2, wherein a thickness of the oxide film formed in said plug front part is larger than a thickness of the oxide film formed in said plug rear part.

8. A seamless tube piercing/rolling plug according to claim 2, wherein tensile strength of said plug front part is not lower than 50 MPa at 1100° C.

9. A seamless tube producing method wherein an inclined rotary piercing mill pierces/rolls a billet heated to a predetermined temperature into a hollow shell while the plug according to claim 2 is used as a piercing tool.

10. A seamless tube inclined rotary piercing/rolling plug according to claim 1, wherein internal portions each of the plug front part and the plug rear part are configured to receive at least a portion of the mandrel for holding the plug front part and plug rear part as the integral plug.

* * * * *